US006642673B2

(12) United States Patent
Hudson et al.

(10) Patent No.: US 6,642,673 B2
(45) Date of Patent: Nov. 4, 2003

(54) METHOD AND APPARATUS FOR DISABLING SODIUM IGNITOR UPON FAILURE OF DISCHARGE LAMP

(75) Inventors: Christopher Allen Hudson, Roanoke, VA (US); Isaac Lynnwood Flory, IV, Blacksburg, VA (US)

(73) Assignee: Hubbell Incorporated, Orange, CT (US)

( * ) Notice: Subject to any disclaimer, the term of this patent is extended or adjusted under 35 U.S.C. 154(b) by 23 days.

(21) Appl. No.: 09/984,578

(22) Filed: Oct. 30, 2001

(65) Prior Publication Data

US 2002/0074952 A1 Jun. 20, 2002

Related U.S. Application Data

(60) Provisional application No. 60/246,594, filed on Nov. 8, 2000.

(51) Int. Cl.[7] ..... H05B 37/00

(52) U.S. Cl. ..... 315/290; 315/289; 315/246; 315/360; 315/274; 315/209 SC

(58) Field of Search ..... 315/290, 289, 315/246, 360, 274, 209 R, 209 SC, 209 CD, 209 T, 307

(56) References Cited

U.S. PATENT DOCUMENTS

| | | | | |
|---|---|---|---|---|
| 3,979,601 A | | 9/1976 | Franklin | 307/141 |
| 4,155,032 A | | 5/1979 | Schlick et al. | 315/307 |
| 4,207,500 A | | 6/1980 | Duve et al. | 315/119 |
| 4,896,077 A | | 1/1990 | Dodd et al. | 315/289 |
| 4,962,336 A | | 10/1990 | Dodd et al. | 315/290 |
| 4,996,464 A | | 2/1991 | Dodd et al. | 315/289 |
| 5,053,683 A | | 10/1991 | Theroux | 315/290 |
| 5,070,279 A | | 12/1991 | Garbowicz et al. | 315/289 |
| 5,424,617 A | | 6/1995 | Garbowicz et al. | 315/289 |
| 5,838,117 A | | 11/1998 | Nerone | 315/307 |
| 5,886,481 A | | 3/1999 | Flory, IV | 315/290 |
| 5,945,784 A | | 8/1999 | Mattas | 315/247 |
| 6,169,369 B1 | * | 1/2001 | Nerone et al. | 315/106 |

* cited by examiner

*Primary Examiner*—Don Wong
*Assistant Examiner*—Tuyet T. Vo
(74) *Attorney, Agent, or Firm*—Alfred N. Goodman; Stacey Longanecker; Peter L. Kendall

(57) ABSTRACT

An ignitor disabling apparatus is provided to reliably and automatically disable a universal sodium ignitor with hot re-strike capability, or a 120 Hz pulse capability. The ignitor is configured to disable the ignitor portion of a HID lamp if the lamp fails to start. Timing operation of the disabling circuit is achieved using a power supply that ramps to a steady state to provide triggering of a timer circuit. A normally closed, solid state gating device is used for disabling the ignitor to minimize sparks. The disabling apparatus can be retrofit into an existing universal sodium ignitor.

24 Claims, 4 Drawing Sheets

METHOD AND APPARATUS FOR DISABLING SODIUM IGNITOR UPON FAILURE OF DISCHARGE LAMP

CROSS-REFERENCE TO RELATED APPLICATION

The present invention claims benefit under 35 U.S.C. section 119(e) of a provisional U.S. Patent Application of Isaac L. Flory, and Christopher A. Hudson, entitled "Method and Apparatus for Disabling a Sodium Ignitor Upon Failure of Discharge Lamp," Serial No. 60/246,594, filed Nov. 8, 2000, the entire contents of said provisional application being incorporated herein by reference.

Related subject matter is disclosed in U.S. patent application Ser. No. 09/280,581, filed Mar. 30, 1999 now U.S. Pat. No. 5,972,449, the entire contents of said application being expressly incorporated herein by reference.

FIELD OF THE INVENTION

The invention relates generally to a disable circuit that stops the ignitor function of a high intensity discharge (HID) lamp ignition circuit. More particularly, the invention relates to an apparatus and method to control the timing and triggering of the disable function of the igniter circuit.

BACKGROUND OF THE INVENTION

High intensity discharge (HID) lamps such as metal halide (MH) and high pressure sodium (HPS) lamps have increasingly gained acceptance over incandescent and fluorescent lamps for commercial and industrial applications. HID lamps are more efficient and more cost effective than incandescent and fluorescent lamps for illuminating large open spaces such as construction sites, stadiums, parking lots, warehouses, and so on, as well as for illumination along roadways. An HID lamp comprises at least an arc-tube containing two electrodes, chemical compounds and a fill gas. The fill gas can comprise one or more gases. To initiate operation of the lamp, the fill gas is ionized to facilitate the conduction of electricity between the electrodes.

HID lamps can be difficult to start. An HID lamp such as a conventional HPS lamp uses a 2500 to 4000 volt pulse at least once per half-cycle and at selected times during the cycle in order to start, as set forth in a number of standards such as ANSI C78.1350 on HPS lamps, for example. An ignitor is used to provide the necessary pulses to start the conventional HID lamp. If the lamp is extinguished after lamp operation has elevated lamp temperature, the lamp cannot be restarted until after the lamp cools down and the fill gas can be ionized again. For many types of HID lamps, this lamp cooling period can be between approximately 40 seconds and 2.5 minutes, which can be considered unacceptable in situations where, for example, emergency lighting is desired.

A number of circuits have been developed to start or hot restrike HID lamps. These ignitors generally include resistors, pulse transformers and other components, in addition to a conventional ballast. These devices can reduce system efficiencies and substantially increase system cost.

An exemplary ignitor 100 is depicted in FIG. 1. Terminals 102 and 104 of a lighting unit are connected to an AC power source 106, as well as to a ballast 108 and a lamp 110. The ballast 108 comprises a tap 112 and two winding portions 114 and 116. The ignitor 100 has terminals which are connected to terminals 102, 112 and 110. A charging circuit for hot restarting a high pressure xenon HPS lamp or other HID lamp having similar hot restart requirements is provided which comprises a semiconductor switch 118 such as a silicon-controlled rectifier (SCR) or the like is connected so that one end of its switchable conductive path is connected to the end of the first portion 116 of the ballast. The other end of the conductive path of the SCR 118 is connected to the tap 112 via a storage capacitor 120. A number of sidacs 122 or other breakdown devices are connected between the gate and the anode of the SCR 118. A current-limiting resistor 126 is provided in series with the sidacs 122 and 124. If the voltage on the capacitor 120 increases to a level which reaches or exceeds the threshold voltage of the breakdown devices 122 and 124, the sidacs 122 and 124 become conductive, placing the SCR 118 in a conductive state. Accordingly, the capacitor 120 discharges through the portion 18 of the ballast. Because the winding portions 114 and 116 of the ballast are electromagnetically coupled, the portion 116 of the ballast operates as the primary of a transformer in that a voltage is induced in the winding portion 114. The high voltage generated in the winding portion 114 of the ballast 108 is imposed on the lamp 110. The relationship of the winding portions 114 and 116 is selected to create a voltage using the SCR 118 and the sidacs 122 and 124 which is sufficiently high to ionize the material within the arc tube of the lamp 110.

With further reference to FIG. 1, a charging circuit 144 for the capacitor 120 is connected between the tap 112 and the terminal 102 at the other side of the AC power source 106. This charging circuit preferably comprises two diodes 128 and 130, a pumping capacitor 132 and two radio frequency chokes 134 and 136 connected in series between the tap 112 and the terminal 102. Two diodes 138 and 140 are connected between the capacitors 120 and 132 and are poled in the opposite direction from the diodes 128 and 130.

The charging circuit 144 depicted in FIG. 1 provides for the controlled, step-charging of the storage capacitor 120. During one half cycle of the AC power source 106, a current flows through the chokes 134 and 136, the capacitor 132 and the diodes 128 and 130 to charge the capacitor 132. The capacitor 132 is selected to be relatively smaller than the capacitor 120 (e.g., 0.047 microfarads ($\mu$F) versus 5 $\mu$F). On the next half cycle of the AC power source 106, the capacitor 120 is charged and the voltage across the capacitor 132 increases the incoming half wave from the AC power source 106 so as to provide energy on the order of 2.7 microjoules to the storage capacitor 120. Since the capacitor 120 requires more energy due to its relative size, the capacitor 120 can be provided with energy from both the incoming AC signal and the capacitor 132 in one cycle. On the next half cycle, the capacitor is charged again and delivers energy to the capacitor 120 again on the subsequent half cycle. Thus, the charge on the capacitor 120 is increased with each alternate half cycle using a pumping action.

When the capacitor 120 reaches the breakdown voltage of the sidacs 122 and 124, the sidacs become conductive and therefore render the SCR 118 conductive. The capacitor 120 therefore discharges through the portion 116 of the ballast 108 to generate a high voltage in the portion 114 of the ballast. The large magnitude of the capacitor 120 discharges significantly more energy into the magnetic field of the ballast 108 as compared with a conventional HID lamp ignitor and therefore excites the ballast 108 to a relatively high degree. The highly excited ballast 108, with its corresponding collapsing magnetic field, pushes the lamp into a discharge state and therefore a low impedance state so that the discharge state can be maintained by the normal AC power source 106. The discharging capacitor 120 produces current flow which is in the same direction as the continued current flow produced by the collapsing field, and which is provided through the lamp as the SCR 118 is turned off by the instantaneous back voltage bias placed on the capacitor 120 by the same collapsing field energy. The resistor 152 can be connected in series with the SCR 118 to cause the peak of the high voltage pulse to be lower and the base (i.e., width) of the pulse to be longer. The resistor 152 limits the high voltage and therefore reduces dielectric stress to allow the use of lower cost magnetic components.

The ignitor 100 depicted in FIG. 1 further comprises an HPS lamp starting circuit comprising a capacitor 146 connected in series with a resistor 148 and a sidac 150 or similar breakdown device. The resistor 148 is connected to the junction between the inductors 134 and 136 and the capacitor 132. The ignitor 100 comprises a current-limiting resistor 152 in series with the parallel combination of the SCR 118 and the sidacs 122 and 124.

The above-mentioned HID lamps should be provided with a disabling circuit such that, if the lamp fails to start, the disabling circuit would discontinue the hot or cold strike used to initiate the HID lamp. This feature is useful in prolonging the life expectancy of the ignitor, helps protect the ballast system, and provides the ability to apply HID ignitors to harsh and hazardous environments.

Accordingly, a need exists for a reliable means of disabling the ignitor portion of a HID lamp, and an accurate method to time when the disablement of the ignitor occurs. Further, a need exists for a power supply for proper operation of semiconductor devices used in the disabling circuitry, and a solid state contact in the lamp circuit that will not release sparks when actuated by the disabling circuit.

BRIEF DESCRIPTION OF THE DRAWINGS

The various aspects, advantages and novel features of the present invention will be more readily comprehended from the following detailed description when read in conjunction with the appended drawings, in which.

SUMMARY OF THE INVENTION

One aspect of the present invention is to provide a reliable means to disable ignitor operation for operation in harsh and hazardous environments.

Yet another aspect of the present invention is to provide accurate method to time when the disable operation occurs.

Still another aspect of the present invention is to provide a novel method to trigger the start of the time interval.

Another aspect of the present invention is to provide a power supply for proper operation of semiconductor devices.

Another aspect of the present invention is to provide a solid state, normally closed contact that will give no sparks when actuated.

Another aspect of the present invention is to provide the ability to retrofit an existing HID sodium lamp with disable circuitry.

DETAILED DESCRIPTION OF THE PREFERRED EMBODIMENT

Figure 1:
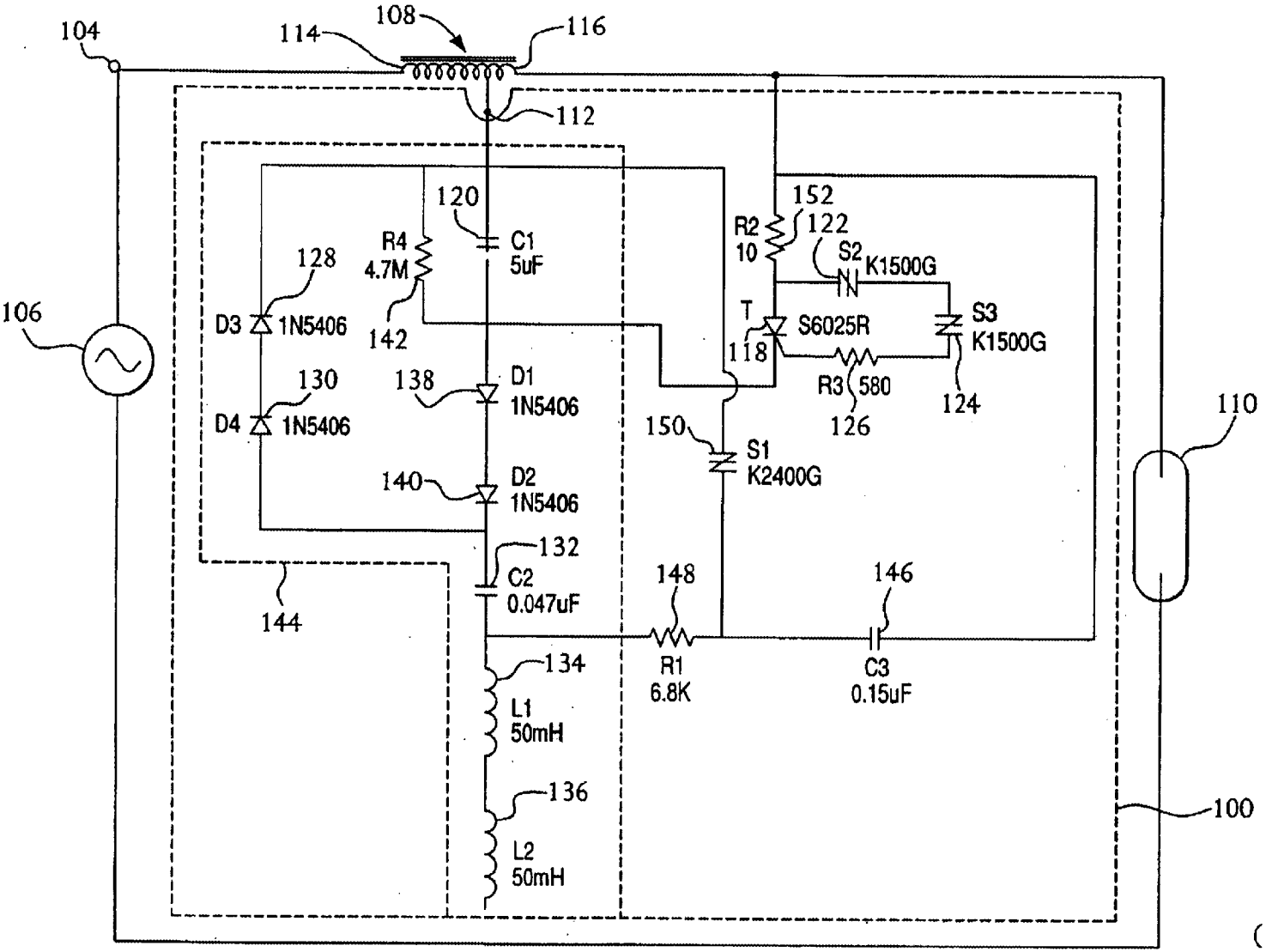
FIG. 1 (PRIOR ART)
FIG. 1 is a schematic diagram of an exemplary existing ignitor.
Figure 2:
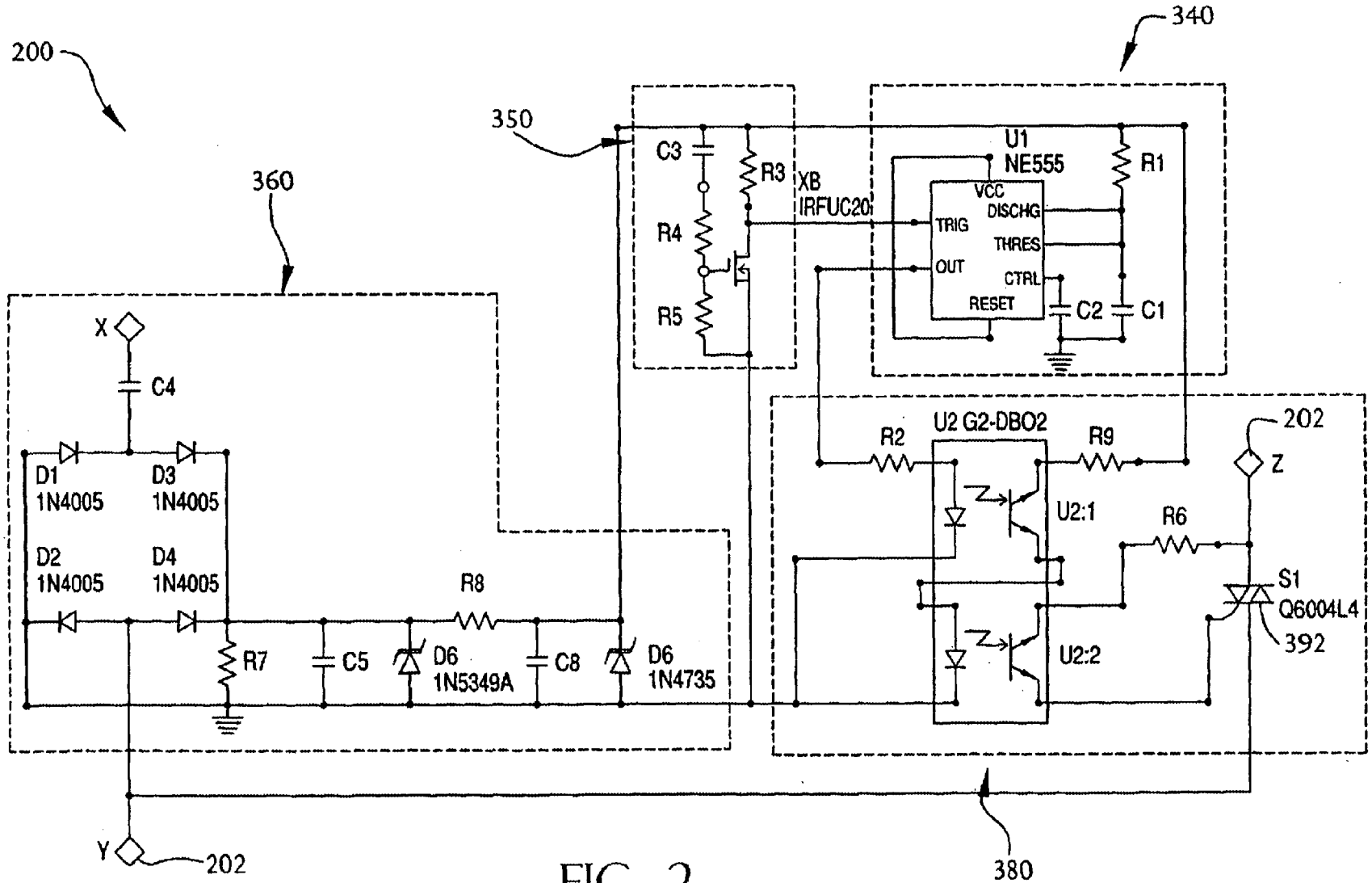
FIG. 2 is a schematic diagram of a circuit having a HID lamp restrike function integrated with a disabling function in accordance with an embodiment of the present invention.
Figure 3:
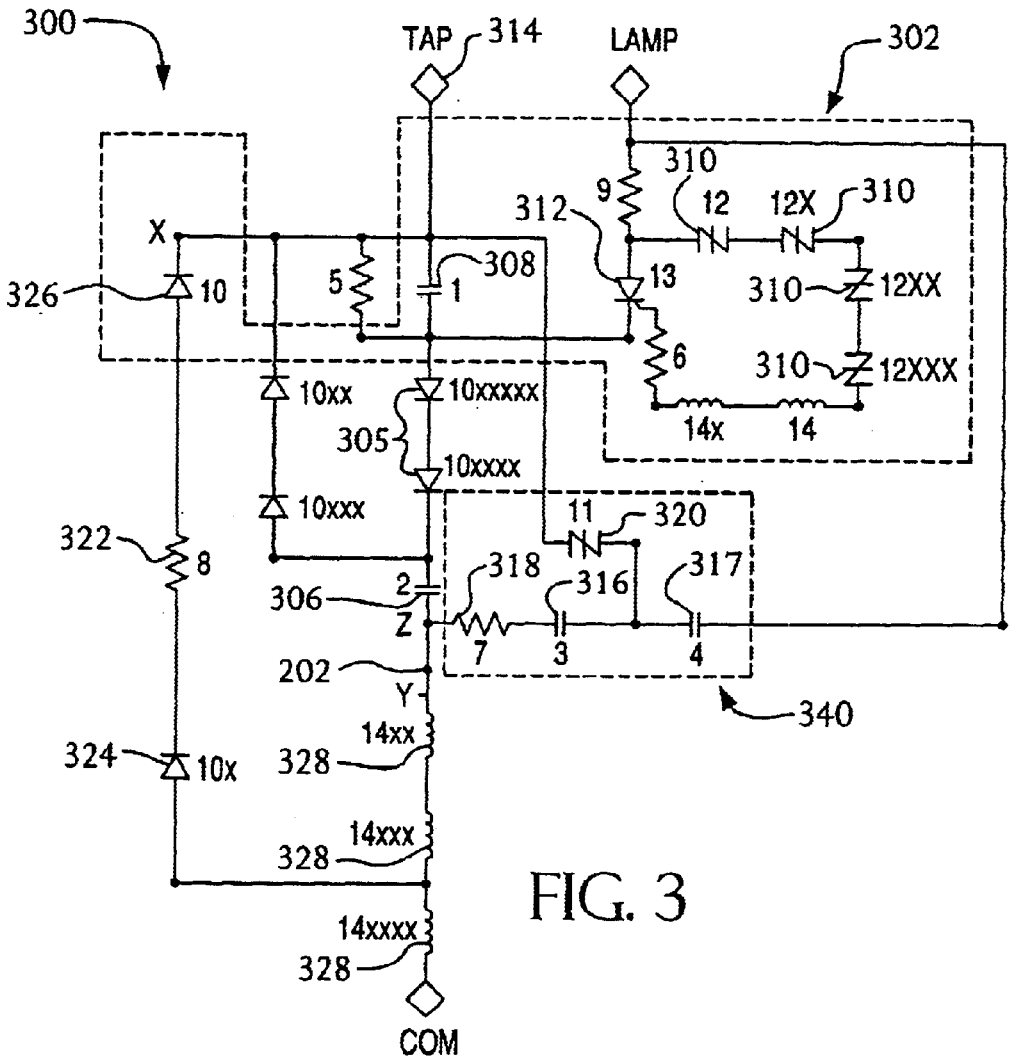
FIG. 3 is a schematic diagram of an universal sodium ignitor constructed in accordance with an embodiment of the present invention

FIG. 2 depicts a disabling circuit 200 provided in accordance with an embodiment of the present invention. Disabling circuit 200 is provided to operate a normally closed triac 392 (FIG. 7) in order to disable the igniter 300 of FIG. 3 of a HID lamp upon failure to start the lamp. By way of an example and as described below, the node 202 in the disabling circuit 200 can be provided in the ignitor 300, as shown in FIG. 3. This disabling feature is useful in prolonging life expectancy of the ignitor, helping to protect the ballast system, and providing the ability to apply HID igniters to harsh and hazardous environments by encapsulating the disabling circuit 200 and igniter 300 of FIG. 3 in a can, for example, or any other appropriate encapsulating product.

Figure 4:
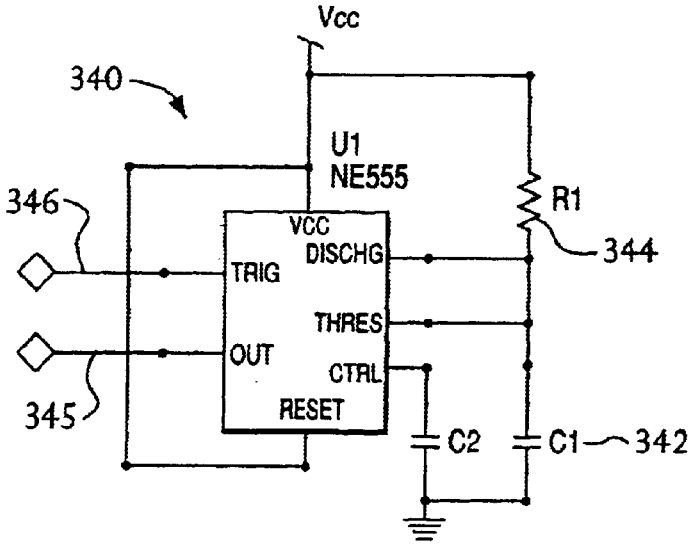
FIG. 4 is a schematic diagram of a timer with an external trigger constructed in accordance with an embodiment of the present invention.
Figure 6:
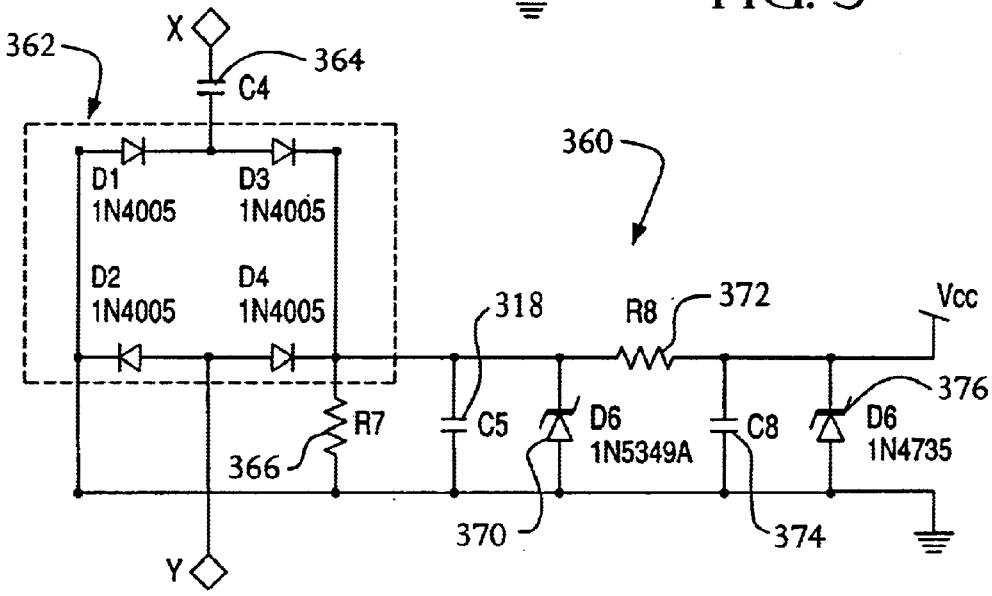
FIG. 6 is a schematic diagram of a power supply with an advantageous ramp up operation constructed in accordance with an embodiment of the present invention.
Figure 7:
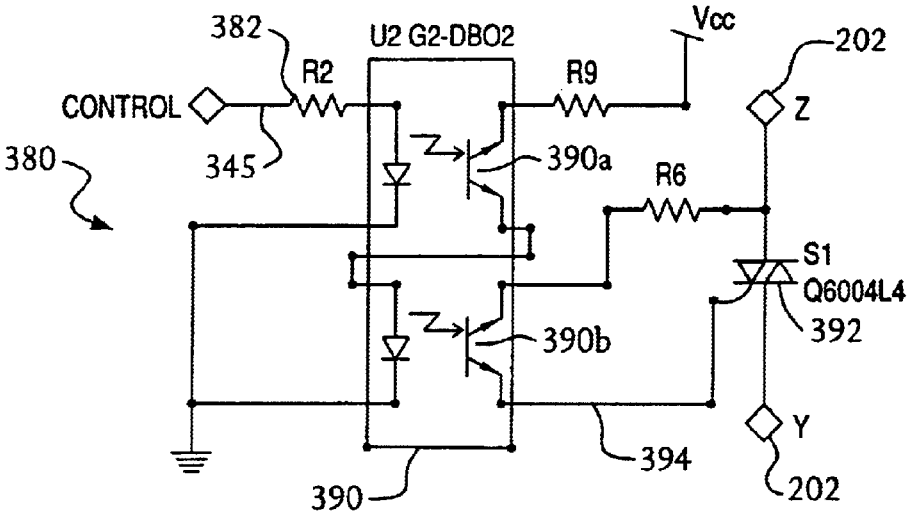
FIG. 7 is a schematic diagram of an isolated solid state switch mechanism constructed in accordance with an embodiment of the present invention.

With continued reference to FIG. 2, the disabling circuit 200 comprises a monostable timer 340 (FIG. 4), a triggering circuit 350 (FIG. 5), a power supply 360 (FIG. 6), and an isolated solid state switch 380 (FIG. 7). Accordingly, when power is applied to the ignitor 300 of FIG. 3, both legs (e.g., the hot restrike function 302, and the standard pulse ignitor 304) of the ignitor begin operation. This allows the power supply 360 to ramp up to a threshold voltage, thus initiating the triggering function of the trigger circuit 350 which, in turn, begins the timer 340. Upon expiration of a pre-selected period of time (e.g., 180 seconds or any other appropriate period of time), the timer 340 activates the solid state switch 380 which, in turn, activates the triac 392, thereby removing power from the ignitor 300 and disabling the ignitor 300.

The ignitor 300 of FIG. 3 produces two types of pulses, as mentioned above, a hot re-strike pulse generated by circuitry 302 and a standard pulse ignitor generated by circuitry 304. The major difference between a standard ignitor 304 and a hot restrike ignitor 302 is that a restart ignitor produces a pulse which is higher in voltage and contains significantly more energy than a pulse generated by a standard ignitor (e.g. on the order of 700 volts). The hot re-strike ignitor is indicated generally at 302 and is a DC ignitor that charges and discharges in one direction only. The rectifiers 305 produce a DC level that increases with each successive half-cycle of the ballast (not shown) secondary voltage. Capacitor 306 is employed in a pumping arrangement to increase the voltage on capacitor 308 to preferably twice the peak open circuit ballast voltage. When the voltage on capacitor 308 reaches a sufficient level to break-over the semiconductors 310, transistor 312 is gated on. The charge in capacitor 308 carries through the tap 314 of the ballast (not shown), thus creating a voltage transformation loop. This high current provided through the tap produces a large voltage on the secondary of the ballast across the sodium lamp. The secondary voltage of is sufficient amplitude such that under certain conditions, the sodium lamp hot re-starts essentially instantly.

With continued reference to FIG. 3, the regular ignitor 304 is an AC ignitor. It charges and discharges through the series combination of capacitors 316 and 317, and resistor 318 in an alternating fashion. The voltage produced across capacitor 317 is sufficient to break-over semiconductor 320. A current pulse is provided at least once per half-cycle in both directions through the tap 314 of the ballast (not shown). In addition, this current pulse preferably provides a high voltage pulse across the sodium lamp in the direction of the ballast (not shown) secondary voltage every half-cycle.

The series combination of resistor 322 and rectifiers 324 and 326 provide a means of storing DC energy in the ballast capacitor (not shown) to facilitate the hot re-start ignitor 302 of the lamp (not shown). Both ignitor legs 302 and 304 feed through the RF chokes 328. If the current through these chokes is terminated, then the pumping action of the ignitor 302 and pulsing action of 304 ceases to function, thus enabling the triac to open at point 202 in FIG. 3. Placing the triac 392 at node 202 in FIG. 3, thus enabling the triac 392 to de-activate, therefore producing the current disruption.

The triac 392 located with in the disable circuit 200 can be opened to cause the ignitor 200 to cease operating. The location of the disable circuit within the ignitor circuit is preferably at point 202 of FIG. 3. This particular insertion point 202 is advantageous because it provides for the protection of the low voltage semiconductors in the disable circuit 200 by placing the circuit inside the RF chokes 328 and away from the two above-referenced ignitor pulses that vary from 3.5 KV to over 7 KV. The disable circuit 200 is self-contained within the same parameters and connections to which the ignitor 200 is subject. The disable circuit preferably maintains its connections internal to the ignitor 200 itself. Thus, the entire package can be configured to have only three external connections, that is, LAMP, TAP, and COM.

Another aspect of the invention is the selection of the appropriate length to allow the ignitor to function before it disables. Since the majority of all sodium lamps will re-ignite after approximately 90 seconds, the interval disable time period is selected to be at least twice this period (i.e., a 180-second disable interval). Accordingly, the timer includes a timing cycle of approximately 180 seconds, for example. In addition, there are primarily two modes of operation of the timer 340: astable and monostable. An embodiment of the present invention employs the monostable mode which is a method by which a 555 timer is preferably provided. An RC time constant is employed to place the timer output at high for a given duration, set by the RC time constant, and then return the output to low.

Figure 5:
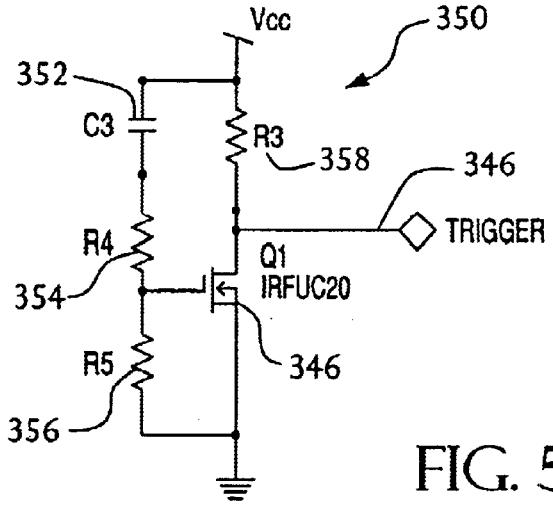
FIG. 5 is a schematic diagram of an analog trigger mechanism constructed in accordance with an embodiment of the present invention

However, the timer's timing cycle does not begin until an external trigger, such as the triggering circuit in FIG. 5, starts the operation. The trigger voltage generated by the triggering circuit preferably starts at a level greater than that of Vthresh (FIG. 4), and then decreases below this level before rising above it once again. When the trigger voltage rises above the level of Vthresh, the timing cycle begins. The duration of the cycle is given by the following equation:

$$\tau := R \cdot C \cdot \ln\left(\frac{Vcc}{Vcc - Vth}\right)$$

$$\tau := 1.1 \cdot R \cdot C$$

wherein capacitor 342=47 microfarads, t=180 seconds and resistor 344=3.4 megohms (approx,) Resistor 344 is preferably 3.9 megohms which is the closest standard value. It is desirable to start the time duration immediately upon the application of power to the ignitor system. Accordingly, a trigger/control mechanism is needed to provide the means to start the timer operation. As described above, the three conditions employed to appropriately begin the operation of a timer 340 via an external trigger pulse 346 are:

1. Vtrig≧Vthresh during time 1
2. Vtrig≦Vthresh during time 2
3. Vtrig≧Vthresh during time 3

To achieve state 1 above, a pull-up resistor 358 is applied to the trigger pin 346 of the timer 340. Thus, the voltage at the trigger pin 346 is on the order of Vcc. To achieve state 2 above, a transistor 348 of the trigger circuit 350 of FIG. 5 is also connected to the trigger pin 346. When gated, even for a short duration, the transistor 348 pulls pin 346 to ground. To achieve state 3 above, the transistor 348 is turned off. The pull-up resistor 358 allows the trigger pin 346 to rise to Vcc again.

The control of the transistor 348 gate signal is an important aspect of an embodiment of the present invention. Transistor 348 is controlled via the DC charge of capacitor 352 via resistors 354 and 356. Resistor 356 provides a means for the gate to go to ground when no current flows through resistor 354 (i.e. a pull down resistor). Whittle Vcc charges to a steady DC level, so does capacitor 352. Current flows through the resistor 354 and the capacitor 352 series combination, thereby tuning on the transistor 348. The trigger pin 346 is therefore pulled to ground. When capacitor 352 has approximately reached the level of Vcc, it allows no more current to pass. This effectively turns off the transistor 348. As mentioned above, transistor 348 turns off and the timer's trigger pin 346 rises to Vcc, thereby starting the timer's 340 timing cycle. An embodiment of the present invention employs a high pass filter via capacitor 352 and resistor 354 and a power supply as described in detail below (e.g., one that ramps up to its steady state), to directly supply the gate current needed in order to properly turn on and off the transistor 348. When the power supply 360 ramps up, the high pass filter gates the transistor 348. When the power supply maintains a steady state, the high pass filter provides no current to the gate of the transistor 348. The gate is therefore pulled to ground via the resistor 356 and the transistor 348 is turned off.

The power supply 360 of FIG. 6 is important to the application of the timer 340 described above. The power supply 360 has two characteristics that achieve proper operation of the timing circuit 340. First, it has a steady state, regulated voltage that has at least the minimum required DC for proper operation of the timer (e.g., on the order of 4.2 volts). Second, the power supply ramp up to the steady state is of sufficient frequency that the high pass filter passes current to the transistor 348, thus activating the trigger and timing cycle. A rectifying bridge 362 is preferably provided to gain DC current to the power supply regulating circuit 360. A two-stage circuit is employed to ensure a high degree of regulation and the proper current draw through capacitor 364 which drops the open circuit voltage (OCV) of the ballast (not shown) from 400 V peak to about 10 V peak when measured at the diode bridge 362. Resistor 366 is preferably provided across the output of the bridge 362 to ensure that enough current is drawn to produce the open circuit voltage and to discharge any residual charge left on capacitors 368 and 374. There is no bandwidth limitation to the charge of capacitor 368. Thus, whatever voltage peak is produced across resistor 366, the capacitor 368 achieves this level in one cycle. In other words, the charge current to capacitor 368 is not regulated or limited by a resistor. The zener diode 370 has been placed across the output of the bridge 362 to provide over-voltage protection and pre-regulation of the second power stage. The low pass filter combination of resistor 372 and capacitor 374 gives the required ramp up on the voltage output of the power supply 360. The charge frequency of capacitor 374 is fast enough to overcome the bandwidth limitation of the transistor control. The charge frequency is:

$$f=1/(2*\pi*(R8*C6))=800 \text{ kHz}.$$

Zener diode 376 has been placed across the output of the power supply 360 to regulate the steady state condition at no more than 6.2 VDC. This protects the timer circuit 340 from failure.

The timer 340, the trigger circuit 350, and the power supply 360 work in conjunction with each other to operate the solid state switch mechanism 380 illustrated in FIG. 7. The switch mechanism 380 is employed to operate the triac 392 at point 202 of ignitor 300. The switching mechanism substantially comprises a two stage opto-isolater 390, and a triac 392. The gate of the triac 392 is controlled by the output of the opto-isolator 390. There are two opto-isolaters contained in one package, connected in a cascaded fashion; therefore, the state of the first device determines the state of the second.

The opto-isolater 390 has DC inputs on line 345 and solid state contacts that are normally closed. The typical state for the disable circuit 200 is to allow the ignitor to operate normally. However, upon expiration of the timer 340, the control of the first of the opto-isolaters 390*a* is high, and the triac 392 is on. When the control goes low on line 345, opto-isolater 390*a* has a shorted output, thus activating the input of 390*b*. By activating 390*b*, the output of 390*b* opens, thus allowing no current through the triac 392, and therefore disabling the ignitor 300. The triac 392 remains off until the input 44 390*a* goes high and once again activates the triac 392.

The reliability of the disable feature is extremely consistent. Accordingly, the entire system is not sensitive to component variation, since the power supply 360 is regulated and the timer 340 is accurate. The largest concern is the tolerance of the components on the timer 340 portion. Timers can vary from lot to lot and the disable time interval may vary from ignitor to ignitor on the order of 5%, (i.e., typically about a 30-second difference between the fastest disable and the slowest disable). However, the design constraint of the timer 340 being twice the maximum re-strike (e.g., 180 seconds) time provides an ample buffer to overcome the tolerance issues of any timer circuit.

Additionally, it should be noted that the disable circuit 200, as shown in FIG. 2, can be retrofitted onto any existing universal sodium ignitor circuit, as shown in FIG. 3, when the disable feature is placed at point 202 of the ignitor 300. This allows further flexibility for the disable circuit in accordance with an embodiment of the present invention.

Although only several exemplary embodiments of the present invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. An ignitor disabling circuit coupled to at least one of a plurality of ignitor circuits within a lamp, said ignitor disabling circuit comprising:

a timer circuit operable to generate a timing signal after a selected period of time, said timing signal being operable to disable at least one of said ignitor circuits;

a power supply operable to provide a power signal to said timer circuit;

a triggering circuit coupled to said timer and to said power supply, said triggering circuit operable to initiate said timer for said selected period of time upon occurrence of a pre-determined condition comprising a three state signal occurring at said timer circuit; and a gating circuit coupled to said timer, said gating circuit operable to disable said at least one of a plurality of ignitor circuits upon expiration of said selectable period of time at said timer circuit.

2. A circuit as claimed in claim 1, said timer circuit receiving a triggering voltage from said triggering circuit and said power supply generating a threshold voltage at said timer circuit, wherein said pre-determined condition comprises a first state wherein said triggering voltage is greater than said threshold voltage, followed by a second state wherein said triggering voltage is less than said threshold voltage, followed by a third state wherein said triggering voltage is greater than said threshold voltage.

3. A circuit as claimed in claim 1, wherein said power supply comprises a capacitive device coupled in series to a plurality of rectifying devices and operable to reduce the open circuit voltage of a ballast associated with said lamp, said rectifying devices coupled in parallel to a resistor and capacitor combination operable to charge to a selected voltage, and a low pass filter operable to ramp up to said selected voltage and achieve a steady state to provide said predetermined condition.

4. A circuit as claimed in claim 1, wherein said triggering circuit comprises a triggering output to supply a trigger voltage to said timer circuit, a transistor coupled in series to said input, and a plurality of resistive devices and a capacitive device in parallel to said output to said timer circuit.

5. A circuit as claimed in claim 1, wherein said gating circuit comprises a control input from said timer circuit to said gating circuit coupled in series to at least one resistive device, and said resistive device coupled in series to a plurality of isolating devices, and said isolating device coupled in series to a gating device via at least one resistive device.

6. A circuit as claimed in claim 1, wherein said selectable period of time is 180 seconds.

7. A circuit as claimed in claim 1, wherein said timer comprises a NE 555 timer.

8. A circuit as claimed in claim 1, wherein said plurality of ignitor circuits comprises a 120 Hz pulse circuit, and a hot re-strike pulse circuit.

9. A circuit as claimed in claim 1, wherein said power signal comprises a minimum voltage for proper operation of said timer circuit, and a minimum frequency of said power signal to allow said power signal to activate said triggering device via said timer circuit.

10. A circuit as claimed in claim 9, wherein said minimum voltage comprises 4.2 Volts.

11. A method for disabling at least one of a plurality of ignitor circuits within a lamp, said method comprising:

generating a timing signal via a timer circuit after a selected period of time;

operating a power supply to ramp up to a regulated steady state voltage for operation of said timer circuit;

activating a triggering device upon receiving a selected voltage from said power supply to activate said timer circuit;

providing a three state signal to activate said timer circuit; and initiating a gating device upon expiration of said selected period of time to terminate operation of said at least one of a plurality of ignitor circuits.

12. A method as claimed in claim 11, wherein said activating step further comprises:

receiving a triggering voltage at said timer circuit from said triggering device;

generating a threshold voltage at said timer circuit; and initiating said timer circuit for said selected period of time when a pre-determined condition occurs characterized by a first state wherein said triggering voltage is greater than said threshold voltage, followed by a second state wherein said triggering voltage is less than said threshold voltage, followed by a third state wherein said triggering voltage is greater than said threshold voltage.

13. A method as claimed in claim 11, wherein said selected period of time comprises 3.5 minutes.

14. A method as claimed in claim 11, wherein said regulated steady state voltage comprises 4.2 Volts.

15. A method as claimed in claim 11, wherein said initiating step further comprises:

receiving an input at said gating circuit upon expiration of said selected period of time; and terminating signaling at said gating circuit thereby stopping signaling at said at least one of a plurality of ignitor circuits upon receipt of said input.

16. A method as claimed in claim 15, wherein said input comprises a low input.

17. A method as claimed in claim 15, wherein said stopping step further comprises creating an open circuit condition at said gating circuit via a triac component.

18. An ignitor disabling circuit coupled to at least one of a plurality of ignitor circuits within a lamp, said ignitor disabling circuit comprising:

a timer circuit operable to generate a timing signal after a selected period of time, said timing signal being operable to disable at least one of said ignitor circuits;

a power supply operable to provide a power signal to said timer circuit;

a triggering circuit coupled to said timer and to said power supply, said triggering circuit operable to initiate said timer for said selected period of time upon occurrence of a pre-determined condition occurring at said timer circuit; and a gating circuit coupled to said timer, said gating circuit operable to disable said at least one of a plurality of ignitor circuits upon expiration of said selectable period of time at said timer circuit;

wherein said timer circuit receives a triggering voltage from said triggering circuit and said power supply generates a threshold voltage;

wherein said pre-determined condition comprising a first state wherein said triggering voltage is greater than said threshold voltage, followed by a second state wherein said triggering voltage is less than said threshold voltage, followed by a third state wherein said triggering voltage is greater than threshold voltage.

19. An ignitor disabling circuit coupled to at least one of a plurality of ignitor circuits within a lamp, said ignitor disabling circuit comprising:

a timer circuit operable to generate a timing signal after a selected period of time, said timing signal being operable to disable at least one of said ignitor circuits;

a power supply operable to provide a power signal to said timer circuit;

a triggering circuit coupled to said timer and to said power supply, said triggering circuit operable to initiate said timer for said selected period of time upon occurrence of a pre-determined condition occurring at said timer circuit; and a gating circuit coupled to said timer, said gating circuit operable to disable said at least one of a plurality of ignitor circuits upon expiration of said selectable period of time at said timer circuit;

wherein said power supply comprises a capacitive device coupled in series to a plurality of rectifying devices and operable to reduce the open circuit voltage of a ballast associated with said lamp, said rectifying devices coupled in parallel to a resistor and capacitor combination operable to charge to a selected voltage, and a low pass filter operable to ramp up to said selected voltage and achieve a steady state to provide said pre-determined condition.

20. An ignitor disabling circuit coupled to at least one of a plurality of ignitor circuits within a lamp, said ignitor disabling circuit comprising:

a timer circuit operable to generate a timing signal after a selected period of time, said timing signal being operable to disable at least one of said ignitor circuits;

a power supply operable to provide a power signal to said timer circuit;

a triggering circuit coupled to said timer and to said power supply, said triggering circuit operable to initiate said timer for said selected period of time upon occurrence of a pre-determined condition occurring at said timer circuit; and a gating circuit coupled to said timer, said gating circuit operable to disable said at least one of a plurality of ignitor circuits upon expiration of said selectable period of time at said timer circuit;

said power signal comprises a minimum voltage for proper operation of aid timer circuit, and a minimum frequency of said power signal to allow said power signal to activate said triggering device via said timer circuit, and said minimum voltage comprises 4.2 Volts.

21. An ignitor disabling circuit coupled to at least one of a plurality of ignitor circuits within a lamp, said ignitor disabling circuit comprising:

a timer circuit operable to generate a timing signal after a selected period of time, said timing signal being operable to disable at least one of said ignitor circuits;

a power supply operable to provide a power signal to said timer circuit;

a triggering circuit coupled to said timer and to said power supply, said triggering circuit operable to initiate said timer for said selected period of time upon occurrence of a pre-determined condition occurring at said timer circuit; and a gating circuit coupled to said timer, said gating circuit operable to disable said at least one of a plurality of ignitor circuits upon expiration of said selectable period of time at said timer circuit;

said gating circuit comprises a control input from said timer circuit to said gating circuit coupled in series to at least one resistive device, and said resistive device coupled in series to a plurality of isolating devices, and said isolating device coupled in series to a gating device via at least one resistive device.

22. An ignitor disabling circuit coupled to at least one of a plurality of ignitor circuits within a lamp, said ignitor disabling circuit comprising:

a timer circuit operable to generate a timing signal after a selected period of time, said timing signal being operable to disable at least one of said ignitor circuits;

a power supply operable to provide a power signal to said timer circuit;

a triggering circuit coupled to said timer and to said power supply, said triggering circuit operable to initiate said timer for said selected period of time upon occurrence of a pre-determined condition occurring at said timer circuit; and a gating circuit coupled to said timer, said gating circuit operable to disable said at least one of a plurality of ignitor circuits upon expiration of said selectable period of time at said timer circuit; said plurality of ignitor circuits comprises a 120 Hz pulse circuit, and a hot re-strike pulse circuit.

23. A method for disabling at least one of a plurality of ignitor circuits within a lamp, said method comprising:

generating a timing signal via a timer circuit after a selected period of time;

operating a power supply to ramp up to a regulated steady state voltage for operation of said timer circuit;

activating a triggering device upon receiving a selected voltage from said power supply to activate said timer circuit; and initiating a gating device upon expiration of said selected period of time to terminate operation of said at least one of a plurality of ignitor circuits, said activating step further comprising receiving a triggering voltage at said timer circuit from said triggering device;

generating a threshold voltage at said timer circuit; and initiating said timer circuit for said selected period of time when a pre-determined condition occurs characterized by a first state wherein said triggering voltage is greater than said threshold voltage, followed by a second state wherein said triggering voltage is less than said threshold voltage, followed by a third state wherein said triggering voltage is greater than said threshold voltage.

24. A method for disabling at least one of a plurality of ignitor circuits within a lamp, said method comprising:

generating a timing signal via a timer circuit after a selected period of time;

operating a power supply to ramp up to a regulated steady state voltage for operation of said timer circuit;

activating a triggering device upon receiving a selected voltage from said power supply to activate said timer circuit; and initiating a gating device upon expiration of said selected period of time to terminate operation of said at least one of a plurality of ignitor circuits, said activating step further comprises receiving an input at said gating circuit upon expiration of said selected period of time; and terminating signaling at said gating circuit thereby stopping signaling at said at least one of a plurality of ignitor circuits upon receipt of said input, said stopping comprising creating an open circuit condition at said gating circuit via triac component.

* * * * *